US005362043A

United States Patent [19]

Grellman

[11] Patent Number: 5,362,043

[45] Date of Patent: Nov. 8, 1994

[54] ROTATING CLAMP ASSEMBLY

[75] Inventor: H. Erwin Grellman, Beaverton, Oreg.

[73] Assignee: Tektronix, Inc., Wilsonville, Oreg.

[21] Appl. No.: 105,257

[22] Filed: Aug. 12, 1993

[51] Int. Cl.[5] ..... B65H 9/00

[52] U.S. Cl. ..... 271/277; 101/409; 271/268

[58] Field of Search ..... 400/120 MP; 101/409; 271/204, 82, 268, 277

[56] References Cited

U.S. PATENT DOCUMENTS

| | | | |
|---|---|---|---|
| 3,918,707 | 4/1975 | Villemer et al. | 271/277 |
| 5,092,698 | 3/1992 | Narui et al. | 101/409 |
| 5,141,221 | 8/1992 | Mack et al. | 271/270 |

FOREIGN PATENT DOCUMENTS

| | | | |
|---|---|---|---|
| 0340925 | 11/1989 | European Pat. Off. | 101/409 |
| 403284964 | 12/1991 | Japan | 101/409 |

OTHER PUBLICATIONS

*Color Thermal Printer Engine, Model JX-560 (4694)*, Sharp Service Manual, Contents page and pp. 1–28, published 1990.

*Primary Examiner*—Edgar S. Burr
*Assistant Examiner*—Lynn D. Hendrickson
*Attorney, Agent, or Firm*—Ralph D'Alessandro

[57] ABSTRACT

A rotating print medium retaining clamp is disclosed which securely clamps the print medium or printed image final receiving surface to prevent horizontal or X-axis misregistration while drawing the print medium in a generally circular path through the nip between the platen and the print head. Only the retaining clamp assembly rotates while the support guide remains stationary. The support guide has space for a printing platen to be positioned along the print medium guide path.

14 Claims, 2 Drawing Sheets

ROTATING CLAMP ASSEMBLY

FIELD OF THE INVENTION

This invention related generally to printers and, more specifically, to a printed media or paper handling assembly for use with thermal color printers, such as thermal wax transfer and sublimation dye color printers, and the method of employing such assembly in a color printer.

BACKGROUND OF THE INVENTION

Media handling mechanisms in the field of thermal printing handle the print media, such as paper, by either shuttling the print media back and forth during the printing process or by rotating the media in one direction. When the goal is to efficiently move the print media so that minimal time is required to print multiple colors in color printing, the former approach is less desirable. A more effective approach is the rotation of the print media in one direction so that by the time the bottom of the page is printed, the top of the page is close to the print head for repetitive printing.

One approach which rotates the print medium in one direction uses a clamp that directly attaches the paper onto a circular rubber coated drum that also functions as a platen. Printing occurs directly on the drum and the paper or print medium motion is in a continuous circle. This method has the advantage of actuating the print medium clamp merely by reversing the direction of rotation of the drum. However, a disadvantage of this approach is that a wide and expensive print head is required because of the shallow tangent angle of the print head to the large diameter drum or platen.

Another approach utilizes two belts which rotate about three rollers, one of which is the printing platen. This approach permits the use of a relatively narrow print head with the attendant reduction in print head cost. However, a distinct disadvantage of this design is the difficulty in achieving good dot to dot registration from one printed pass to another in color printing because of the skew and lateral or x-direction instability of the twin belts.

These problems are solved in the design of the present invention by providing a paper handling assembly for use in a color printer wherein a final receiving substrate, such as paper or a transparency, can be precisely moved a number of times between a platen, a ribbon and a print head to achieve color printing.

SUMMARY OF THE INVENTION

It is an object of the present invention to provide a print media or paper handling mechanism that simply and efficiently moves the final image receiving substrate or print medium to minimize the time necessary to print multiple colors.

It is another object of the present invention to provide an improved printed image final receiving substrate mechanism that will work with a carousel type of ribbon supply mechanism.

It is a feature of the present invention that the print media or paper clamp mechanism rotates about a generally horizontal axis to draw the final receiving substrate or print medium tautly about a predetermined generally arcuate path past a print head and printing station.

It is another feature of the present invention that the assembly employs a continuous generally circular path of movement of the final receiving surface or print medium.

It is still another feature of the present invention that accurate registration of the final receiving substrate or print medium with the print head is achieved.

It is yet another feature of the present invention that only the clamp assembly rotates and is independent of the arcuate support guide.

It is yet a further feature of the present invention that the clamp assembly and the platen rotation are independently controlled.

It is an advantage of the present invention that printing time is minimized by the use of the continuous circular movement of the final receiving surface.

It is another advantage of the present invention that paper and transparencies can be used as the final receiving substrate or print medium.

It is still another advantage of the present invention that a compact design can be employed to reduce the cost of the printer.

It is yet another advantage of the present invention that the assembly to handle the printed image final receiving substrate is precise enough to be employable with higher resolution print heads up to at least 600 dots per inch resolution.

It is still a further advantage of the present invention that a small diameter platen can be employed with a narrow or small size print head to further reduce the cost of the printer.

These and other objects, features and advantages are obtained by the one-way rotating printed image final receiving substrate assembly design which securely clamps the final receiving substrate or print medium to prevent horizontal or X-axis misregistration while drawing the printed image final receiving substrate in a generally circular path through the nip between the platen and the print head at least one time and preferably a plurality of times to obtain a final print copy. The number of times the final receiving surface traverses its path through the nip between the platen and the print head is dependent upon the number of colors in the final print copy.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
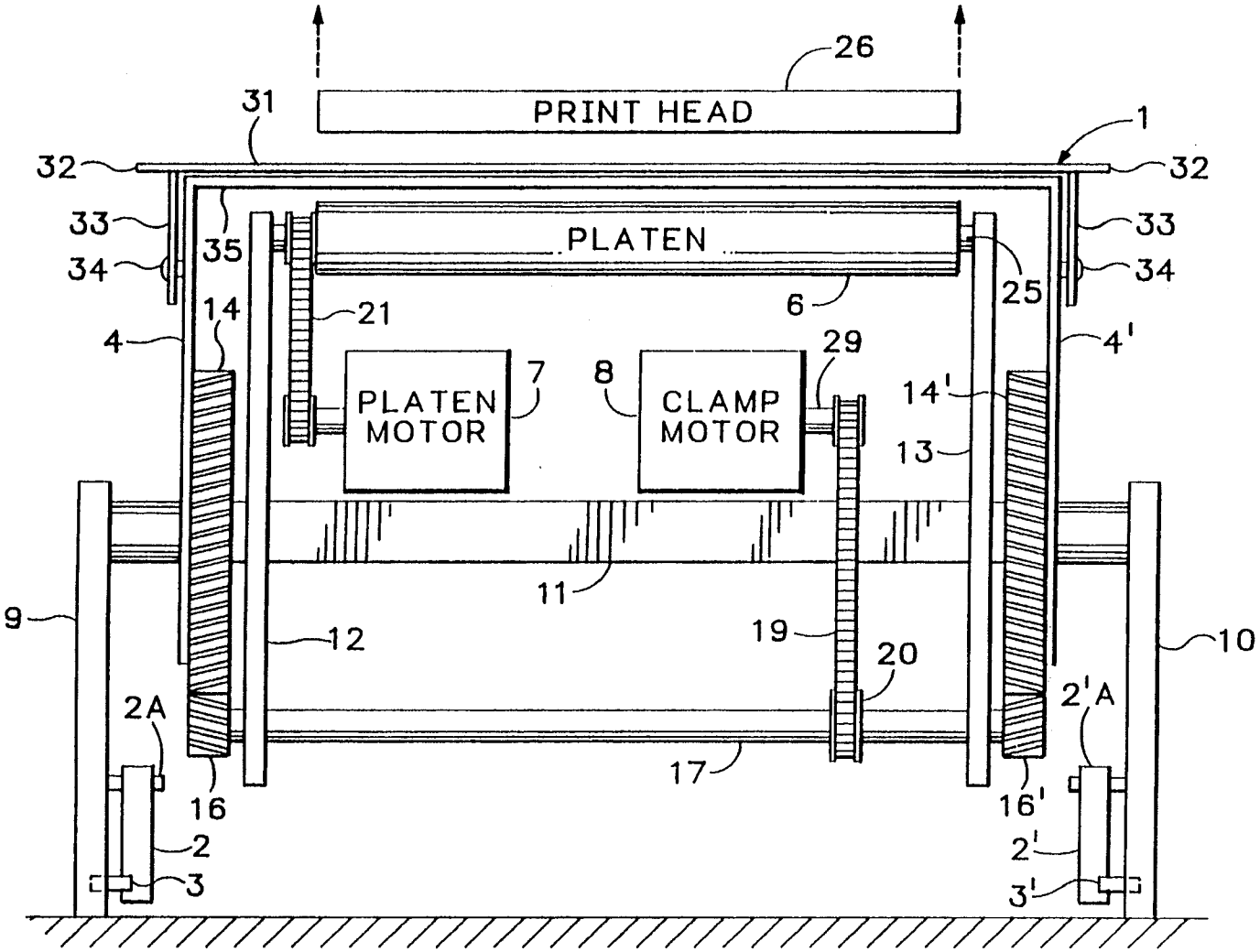
FIG. 1 is a front elevational view of the improved clamp assembly of the present invention in a printer showing the rotating clamp positioned exteriorly of a generally circular support guide which is removed.
Figure 2:
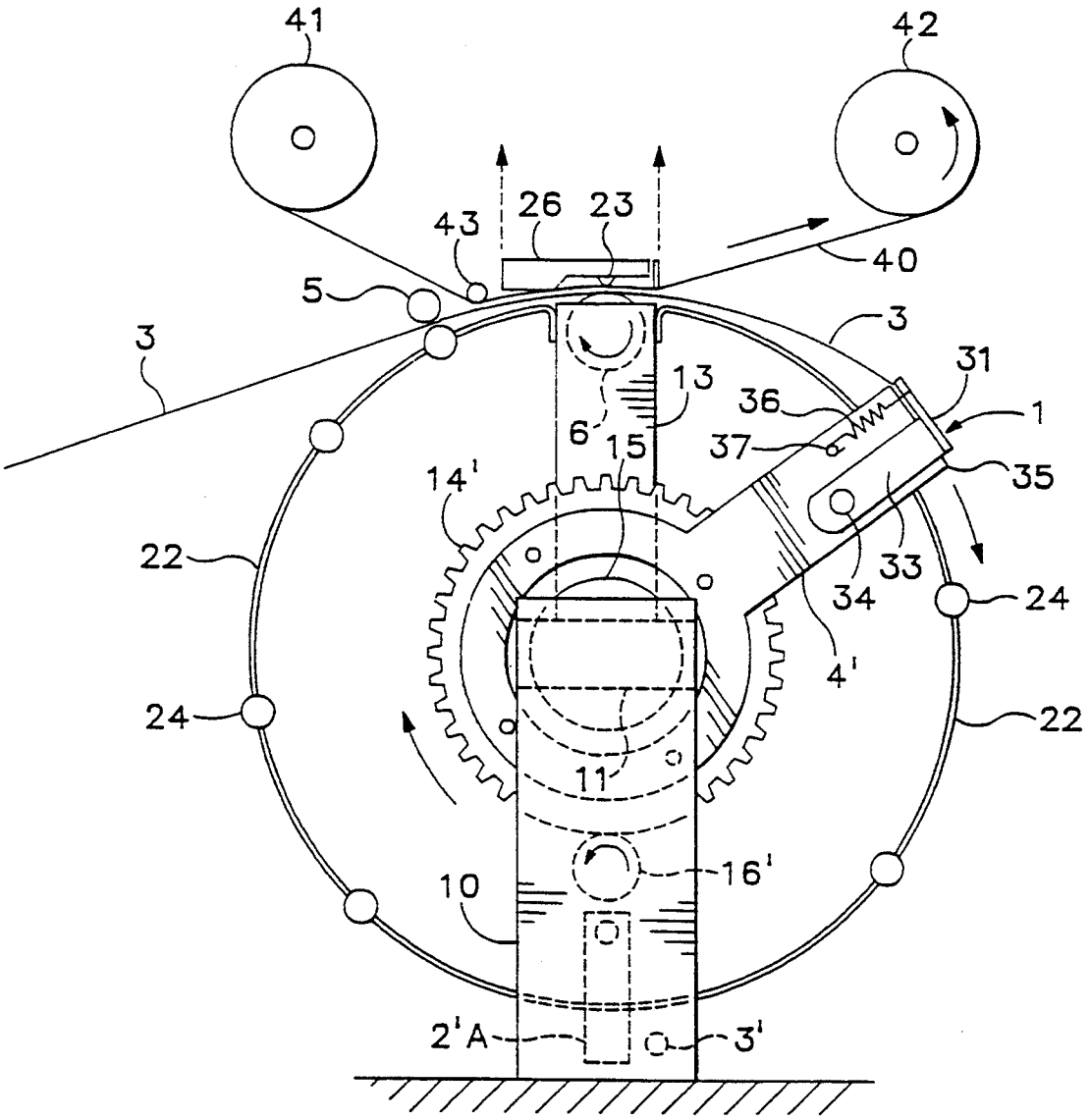
FIG. 2 is a side elevational view of rotating clamp assembly of FIG. 1 using rollers in place of a sheet metal support guide in another potential embodiment of the present invention.

The rotating clamp apparatus, indicated generally by the numeral 1 in FIGS. 1 & 2, consists of two frame supports 9 and 10. A cross member 11 supports the internal frame members 12 and 13. Mounted on the cross member 11 are the platen motor 7 and the clamp motor 8. The components may be made of any suitable material, such as aluminum, stainless steel or heat resistant plastic. A platen 6 is supported by fixed internal frame members 12 and 13. The platen 6 may be rotatably driven, such as by platen motor 7 and belt 21, to rotate about platen shaft and bushing assembly 25. Platen 6 is made from any suitable elastomeric compound, such as neoprene rubber. Platen 6 forms the support surface for the print media or final receiving substrate upon which is printed the output image by the print head 26 of the printer in which the rotating clamp apparatus 1 is employed. Platen 6, in combination with the print head 26, defines the print station or location at the nip 23 therebetween for the printer.

The rotating clamp apparatus has two arms 4 and 4' that attach to and rotate with gears 14 and 14'. Bearings 15, best seen in FIG. 2, are inserted in gears 14 and 14' and are mounted onto cross member 11. Gears 14 & 14' are driven by drive gears 16 and 16' which are attached to drive shaft 17. The rotating clamp assembly 1 rotates in a generally clockwise direction as seen in FIG. 2 when clamp motor 8 is energized, rotating clamp motor shaft and sprocket 29 and turning drive belt 19. Belt sprocket 20, fastened to drive shaft 17, is driven by drive belt 19 so that shaft 17 and gears 16 and 16' rotate to drive rotating clamp assembly gears 14 and 14'. The rotating clamping assembly 1 reversibly rotates about a generally horizontal axis taken through the cross member 11. In the clockwise direction, the clamp stops 2 and 2' of FIG. 2 are hingedly mounted for rotational movement by pins 2A and 2'A in frame supports 9 and 10 so that the pins 2A and 2'A pivot up and out of the path of the clamping assembly 1 when engaged by the clamp plate extensions 32.

Rotating clamp assembly 1 consists of a clamp plate 31 that is preferably spring loaded or otherwise biased and hingedly fastened to the rotating apparatus arms 4 and 4' at pivot pins 34. Clamp plate 31 is biased against clamp base plate 35 so as to apply pressure to retain any print medium between clamp plate 31 and clamp base plate 35. If rotating clamp assembly 1 is rotated counter-clockwise, as seen in FIG. 2, the clamp plate extensions 32 will engage clamp stops 2 and 2'. Clamp stops 2 and 2' are prevented from moving by pins 3 and 3' which in turn activate clamp assembly 1. As is best seen in FIG. 2, having the clamp plate extensions 32 strike the paper clamp stops 2 and 2' causes the clamp plate 31 to pivot about pivot pins 34 against the force of spring 36 which is connected to clamp plate 31 by fitting in a hole (not shown) and a retaining pin 37. Clamp plate 31 is thus pivoted to an open position to permit the desired print medium to be inserted between the top of clamp base plate 35 and clamp plate 31.

Guide 22 is preferably a piece of sheet metal that is attached to and supported by internal frame members 12 and 13. Alternatively, an appropriately heat-resistant plastic material can be utilized. As seen in FIG. 2, guide 22 can include a plurality of rollers 24 spaced about the arcuate medium path that can be appropriately fastened to internal frame members 12 and 13. Alternatively, supporting spokes (not shown) may be used to retain the rollers 24 without the use of the guide 22. This alternative implementation using rollers 24 can reduce the friction of the print medium sliding over the sheet metal should friction become too great. Guide 22 and/or rollers prevent the print medium 3 from collapsing toward the center cross member 11 as the clamp assembly 1 rotates toward the bottom and print medium 3, such as paper, is fed through the nip 23.

In operation, the clamp assembly 1 is in the top or raised position seen in FIG. 1. The clamp apparatus 1 is rotated counter-clockwise exteriorly of guide 22 as seen in FIG. 2 until the clamp plate extensions 32 engage the clamp stops 2 and 2', causing the clamp plate 31 and clamp plate arms 33 to pivot about pivot pins 34 and open. This opens the clamp assembly 1, allowing a sheet of print medium, such as paper 3, to be fed into the clamp assembly 1 with the leading edge of the medium positioned between clamp base plate 35 and clamp plate 31. Print media can be fed into the clamp assembly 1 by any conventional feed mechanism, such as a feed tray with pick rollers.

Once the print medium or paper 3 is in position the clamp assembly is rotated clockwise from the paper loading position at stops 2 and 2' of FIG. 1 so that the clamp plate 31 closes against the clamp base plate 35 grasping the print medium and holding it in position. Only the clamp assembly 1 rotates about the guide support 22, pulling the print medium 3 between the pinch rollers 5 of FIG. 2, and between the thermal print head 26 and platen 6. The support guide 22 remains stationary. An appropriate opening mechanism (not shown) is employed to open the pinch rollers 5 and the thermal print head 26 to allow the clamp assembly 1 to pass between the pinch rollers 5, print head 26 and the support guide 22. The first line of printed output can be printed when the clamp assembly 1 clears the thermal print head 26 and platen 6.

Drivers (not shown) energize the thermal print head 26 to apply ink from the ribbon 40 of FIG. 2. The ink ribbon is fed from a supply roll 41, through the nip 23 between print head 26 and platen 6, and to ribbon take-up roll 42. A ribbon guide roller 43 guides the ribbon into the nip 23 between the print head 26 and the platen 6.

The print medium 3 or paper tension is controlled since the clamp assembly 1 and platen 6 are independently driven by platen motor 7 and clamp motor 8 of FIG. 1. Tension is applied to the print medium 3 between the nip 23 and clamp assembly 1 of FIG. 2.

Biasing means (not shown) can be employed to assist with the paper tensioning. If a print skip feature is implemented with the ribbon supply means or carousel, the position of the print medium 3 must be maintained when the print head 26 is raised to skip. In this implementation the clamp assembly 1 is the primary driver since the platen 6 does not drive the print medium 3 forward when the print head is up. Pinch rollers 5 keep the tension in the print medium 3 to hold the paper taut against the platen 6 of FIG. 2. In this embodiment, platen motor 7 may be replaced by a torque limiter (not shown).

To remove paper from the clamp assembly 1, the clamp assembly 1 of FIG. 2 must rotate clockwise past the bottom until the tail end or trailing edge of the print medium 3 aligns with an appropriate exit guide (not shown). Then the clamp assembly 1 must rotate counter-clockwise until the clamp stop 2 of FIG. 1 opens the clamp plate 31. An eject pinch roller (not shown) or other appropriate mechanism then removes the print medium 3 out of the clamp and deposits it in an appropriate output tray (also not shown). The cycle then repeats itself.

While the invention has been described above with reference to specific embodiments thereof, it is apparent that many changes, modifications and variations in the materials, arrangements of parts and steps can be made without departing from the inventive concept disclosed herein. For example, in employing the clamp assembly 1 of the present invention, it is contemplated that the ribbon 40 utilized by the print head 26 could be one of a plurality of monochrome ink ribbons mounted on a carousel with each ribbon stretched between a pair of spaced-apart spools mounted about the periphery of the carousel. Sufficient spool spacing is provided to provide clearance for the thermal print head to be positioned between the spools to permit the print head to contact the ribbon. The media guide or media support means would be positioned coaxially within the carousel in this configuration. To print a particular color, the carousel would be rotated until the desired color ribbon is in position over the platen 6, the print medium is properly positioned, and then the print head 26 would be lowered into the printing position at the print station to create the nip 23 between the platen 6 and the print head 26. Once the print medium is positioned and the print head is positioned against the ribbon, the print head is electrically driven by an appropriate printer controller to selectively transfer ink from the ribbon to the print medium in the desired pattern. To print a different color, the print head is raised, the carousel rotated or indexed to a different selected ribbon position, the print head is lowered and the printing process is repeated for the newly selected color. When the printing is completed, the print head is raised, the carousel is indexed to the initial position, the print medium is released from the clamping assembly as described above and removed from the printer by being guided along the exit path. Alternatively, the print head also could be located inside the ribbon carousel and the rotatable clamping assembly would be outside of the carousel in a non-coaxial configuration.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. Print media handling means for use in a printer comprising in combination:

(a) frame means for supporting the printer;

(b) stationary media support means for supporting media on which printing is done, the support means being connected to the frame means; and (c) clamping means rotatably mounted to the frame means and cooperative with the media support means to retain media on the media support means and transport the media along a path past a print station where printing on the print media occurs.

2. The apparatus according to claim 1 further comprising each of the print media having a leading edge and a trailing edge and two opposing sides connecting the leading edge and the trailing edge, the clamping means further retaining a one of the media along the leading edge.

3. The apparatus according to claim 2 further comprising the clamping means having a base plate and clamp plate, the clamp plate being movably mounted to the base plate to move between an open position in which a one of the media is inserted and removed from the clamping means and a closed position in which a one of the media is retained along the leading edge for transport along the path past the print station.

4. The apparatus according to claim 3 further comprising the media support means being arcuate.

5. The apparatus according to claim 4 further comprising the media support means being generally circular.

6. The apparatus according to claim 4 further comprising the media support means having a platen positioned therein and connected thereto along the path defining the print station.

7. The apparatus according to claim 6 further comprising the platen being rotatably being mounted to the media support means.

8. The apparatus according to claim 6 further comprising the clamping means being rotatable about a generally horizontal axis passing through the media support means.

9. The apparatus according to claim 8 further comprising the clamping means being exterior of the media support means with respect to the generally horizontal axis.

10. The apparatus according to claim 9 further comprising the clamping means being cooperative with stop means to open the clamp plate when the clamping means is rotated in a second direction opposite to a first direction followed by the the print media along the path to the print station.

11. The apparatus according to claim 10 further comprising the media support means being a generally planar arcuate surface.

12. The apparatus according to claim 10 further comprising the media support means being a plurality of rollers.

13. The apparatus according to claim 11 further comprising the media support means including a plurality of rollers.

14. A method of transporting print media past a print station on a printer comprising the steps of:

(a) inserting a print medium into a retaining means;

(b) rotating the retaining means about a stationary media support means to move the print medium in a generally arcuate path along the media support means to a print station;

(c) moving the print medium through the print station a plurality of times by traversing the arcuate path a corresponding number of times to obtain a printed copy; and (d) reversing the direction of travel of the retaining means along the path to engage a release mechanism to release the print medium and discharge the print medium from the printer.

* * * * *